US006683577B1

(12) United States Patent
Yang et al.

(10) Patent No.: US 6,683,577 B1
(45) Date of Patent: Jan. 27, 2004

(54) PRINTED CIRCUIT ANTENNA

(75) Inventors: Bear Yang, Hsinchu Hsien (TW); Po-Chao Chen, Hsinchu Hsien (TW)

(73) Assignee: SmartAnt Telecom Co., Ltd., Hsinchu (TW)

( * ) Notice: Subject to any disclaimer, the term of this patent is extended or adjusted under 35 U.S.C. 154(b) by 0 days.

(21) Appl. No.: 10/235,539

(22) Filed: Sep. 6, 2002

(51) Int. Cl.[7] ..... H01Q 1/24
(52) U.S. Cl. ..... 343/702; 343/906; 439/916
(58) Field of Search ..... 343/702, 906; 439/188, 248, 916; H01Q 1/24, 1/50

(56) References Cited

U.S. PATENT DOCUMENTS 4,136,986 A * 1/1979 Grashow et al. ..... 403/197
5,278,570 A * 1/1994 Jaramillo et al. ..... 343/702
5,360,353 A * 11/1994 Kinoshita ..... 439/620
5,617,106 A * 4/1997 Tahmassebpur ..... 343/702
6,140,977 A * 10/2000 Morales et al. ..... 343/906
6,473,045 B1 * 10/2002 Duquerroy et al. ..... 343/702
6,543,696 B2 * 4/2003 Nishimura ..... 235/472.01

* cited by examiner

*Primary Examiner*—Tho Phan
(74) *Attorney, Agent, or Firm*—Birch, Stewart, Kolasch & Birch, LLP

(57) ABSTRACT

A printed circuit antenna for applications in electronic devices with wireless transmission abilities. The printed circuit antenna contains a substrate and a connector. Both surfaces of the substrate have a feed line, a feed section and a radiation section for wireless transmissions. The connector connects the substrate to an electronic device, with one end having a surface connecting to the substrate and the other end connecting to the electronic device. The connecting plane has an annular concave area in its central region, separating the connecting plane into two connecting regions. This can increase the connection area between the connector and the substrate to avoid breakings and/or departure.

5 Claims, 6 Drawing Sheets

PRINTED CIRCUIT ANTENNA

BACKGROUND OF THE INVENTION

1. Field of Invention

The invention relates to a printed circuit antenna for applications in wireless electronics and, in particular, to a printed circuit antenna that has an enlarged connecting area between its connector and its substrate so that the antenna can be firmly fixed onto the electronic device.

2. Related Art

Since wireless products become very popular, users can perform wireless data transmissions without constraints from the environment. For such wireless devices such as PDA's, mobile phones, or laptop computers, the antenna is a very important component. The quality of the antenna further has great and direct influence on the quality of wireless transmissions.

Conventional antennas, either dipole antennas or helical antennas, all occupy large space and do not satisfy the current needs and trend. Therefore, manufacturers have designed planar antennas with a fairly small volume. These are the so-called printed circuit antennas or printed antennas.

The printed antenna integrates the wireless transmission system onto a printed circuit. Therefore, not only does it have a small volume, its manufacturing cost is also very cheap. Since the printed antenna does not have a mechanical structure or other connectors, its wireless transmission reliability can be greatly enhanced.

Please refer to FIG. 1A for a conventional printed antenna, which contains an upper shell 71, a lower shell 72, a substrate 73, and a connector 74. The upper and lower shells 71, 72 cover the substrate 73. The substrate 73 contains a circuit for wireless transmissions, the circuit connecting to the substrate through the connector 74. The connector also connects an electronic device. As shown in FIGS. 1B and 1C, the side of the substrate where the connector is connected can be roughly divided into a first conductor 741 in the central part and two arc-shape second conductors 742*a*, 742*b* surrounding the central part. These two parts are insulated and have the same height. Explicitly speaking, there is a groove 743 formed on this end. The two arc-shape second conductors 742*a*, 742*b* are used for connection. Although such a design is based upon manufacturing and circuit deployment on the substrate, the connection area is nevertheless insufficient. It is very likely to break the arc-shape conductors 742*a*, 742*b* during use or assembly, imposing more costs on the manufacturing. Moreover, the connector may be loose when adjusting its angle, resulting in bad data transmission or reception quality.

SUMMARY OF THE INVENTION

In view of the above-mentioned problems, the invention provides a printed antenna that can improve the connection firmness, reduce the manufacturing cost, and enhance its reliability.

The disclosed printed antenna contains a substrate and a connector. Both surfaces of the substrate have a feed section, a feed line, and a radiation section for wireless transmissions. The connector is connected to one of the surfaces for connecting to an electronic device. The end surface of the connector connecting to the substrate has a concave annular insulating region. The annular insulating region separates the end surface into a first connecting region in the central area and a second connecting region surrounding the annular insulating region. Therefore, the conventional groove design is abandoned. The invention greatly increases the connecting area between the connector and the substrate. This can enhance the connection steadiness and avoid unexpected breakings and departures.

Moreover, the printed antenna can be further covered by a shell. In addition to a better appearance, the shell can protect the circuit printed on the substrate. The other surface of the substrate can be installed with an extension connector for connecting with an external antenna, helping achieve better communication effects.

BRIEF DESCRIPTION OF THE DRAWINGS

The invention will become more fully understood from the detailed description given hereinbelow illustration only, and thus are not limitative of the present invention, and wherein.

DETAILED DESCRIPTION OF THE INVENTION

Figure 1A:
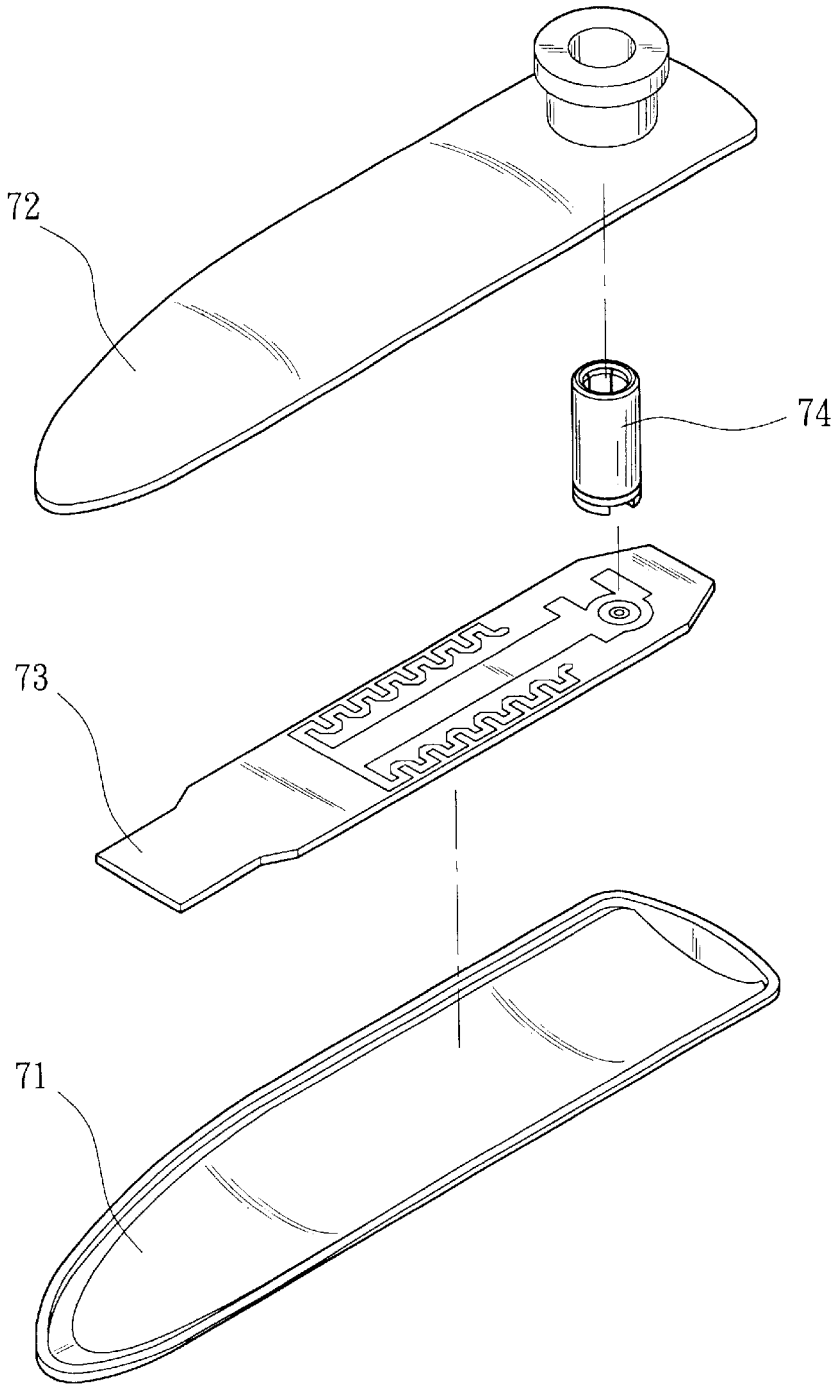
FIG. 1A (PRIOR ART)
FIGS. 1A through 1C are schematic views of a conventional printed antenna.
Figure 1B:
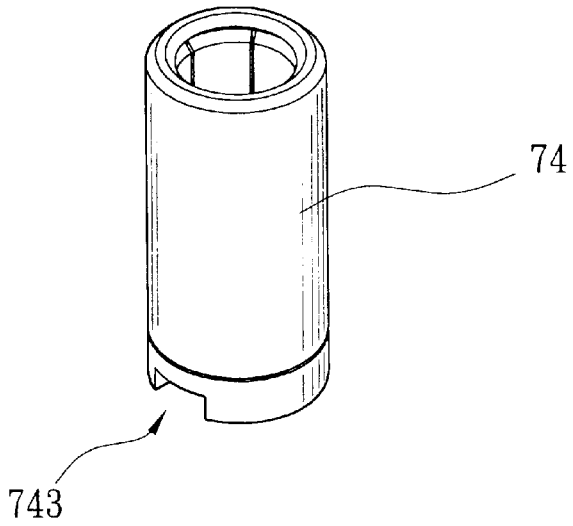
FIG. 1B (PRIOR ART)
Figure 1C:
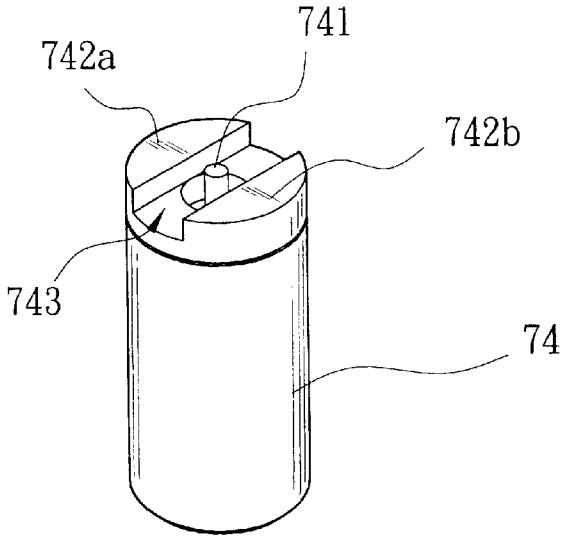
FIG. 1C (PRIOR ART)
Figure 2A:
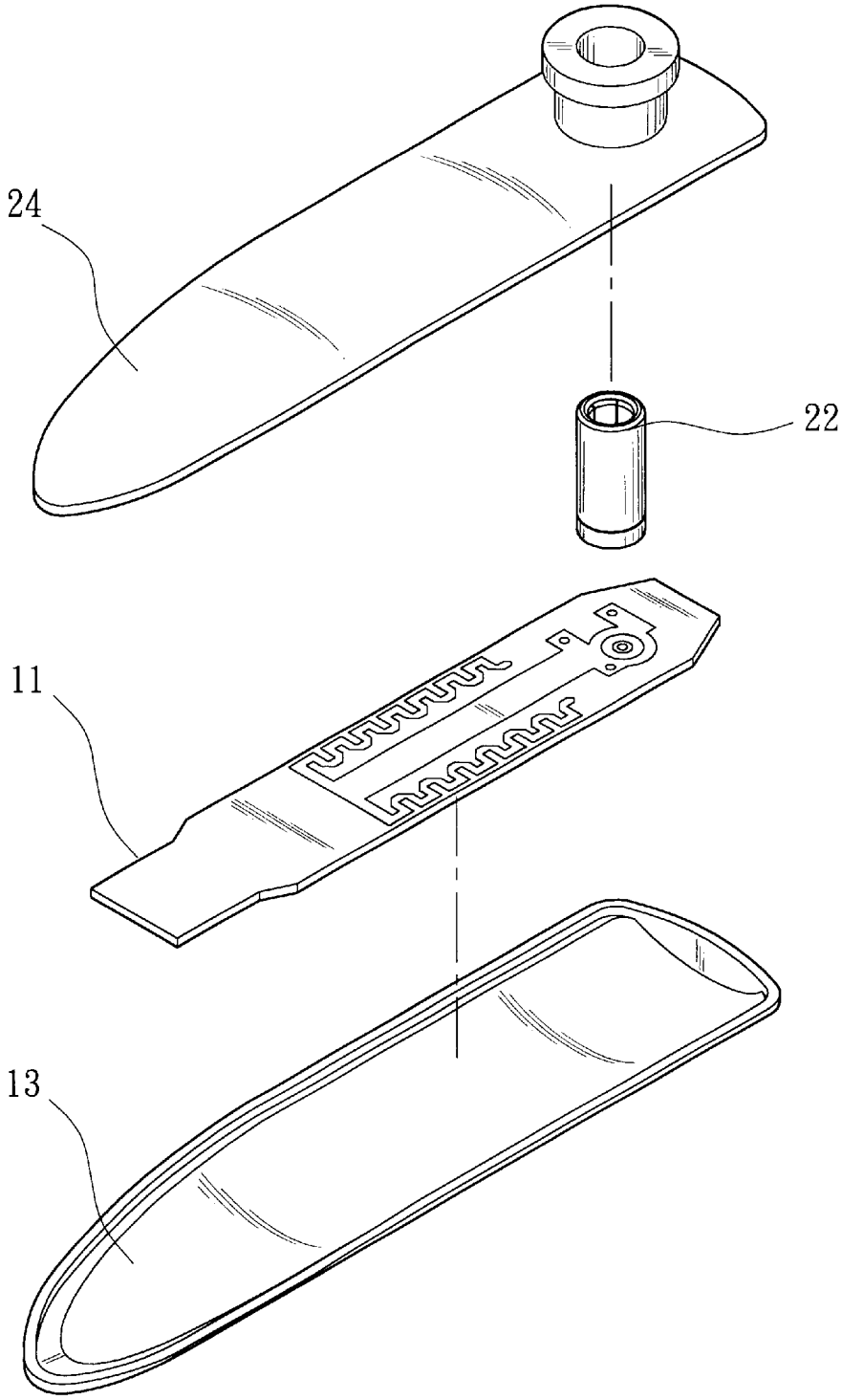
FIGS. 2A through 2C are schematic views of the invention.

Please refer to FIG. 2 for a schematic view of the disclosed printed antenna. It consists of a substrate 11, a connector 22, and a shell comprised of an upper shell 23 and a lower shell 23. The connector 22 is attached to one surface of the substrate 11. With the coverage of the upper shell 23 and the lower shell 24, the circuit on the substrate 11 can be protected and the appearance of the antenna looks nicer. The other end of the connector is connected to an electronic device that uses the antenna.

Figure 3B:
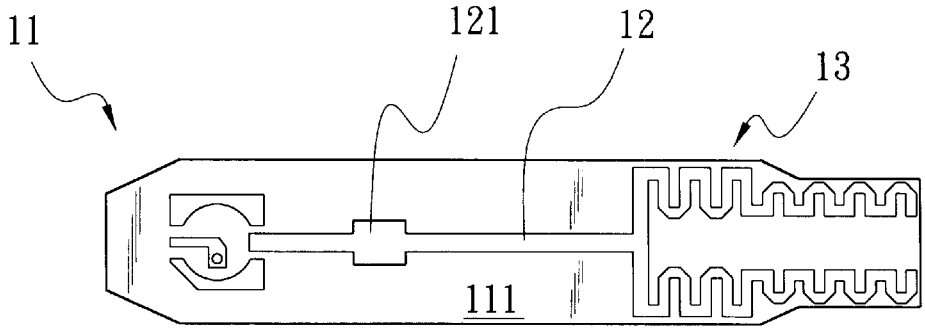
FIGS. 3A and 3B are schematic views of the disclosed substrate.
Figure 3A:
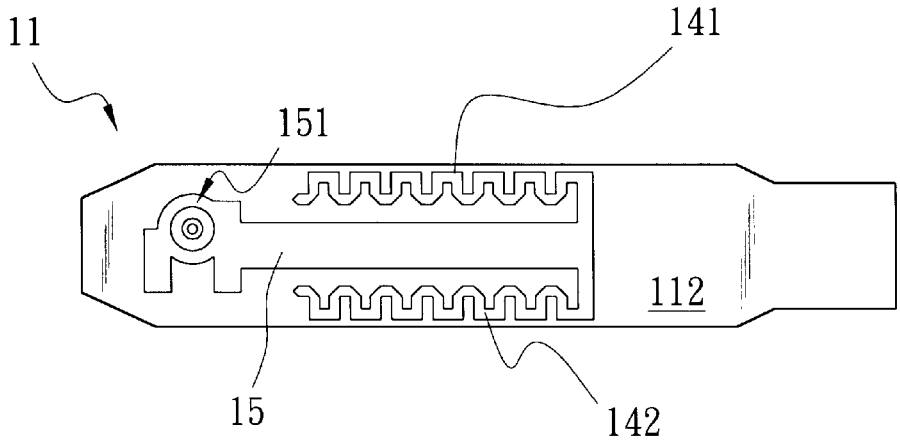

Please refer to FIG. 3A for the substrate and the circuit printed thereon. The substrate 11 can be made of glass fibers or other similar materials. It has two surfaces on the opposite sides, a first surface 112 and a second surface 111. The first surface 112 has a ground line 15 and a second radiation section containing two radiation units 141, 142. The radiation units 141, 142 are parallel to a feed line 12 (introduced later) and the ground line 15. They are provided on each side of the ground line 15 and coupled to the ground line 15. A connecting part 151 is provided at one end for the connector 22 to attach.

The second surface 111 of the substrate 11, as shown in FIG. 3B, has a feed line 12, one end of which connects to the first radiation section 13 and the other end leads to a feed section 121. The position of the ground line 15 corresponds to the corresponding one of the feed line 12. In other words, the central lines of the feed line 12 and the ground line 15 are on the same vertical plane.

Figure 2B:
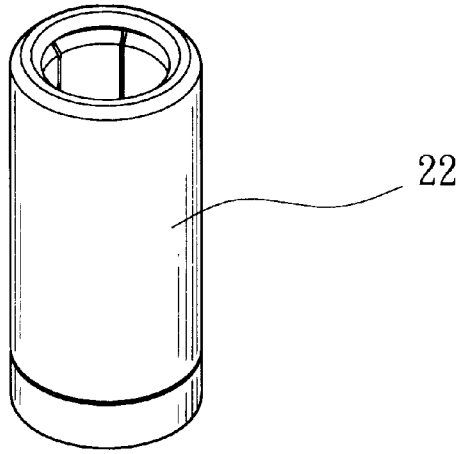
Figure 2C:
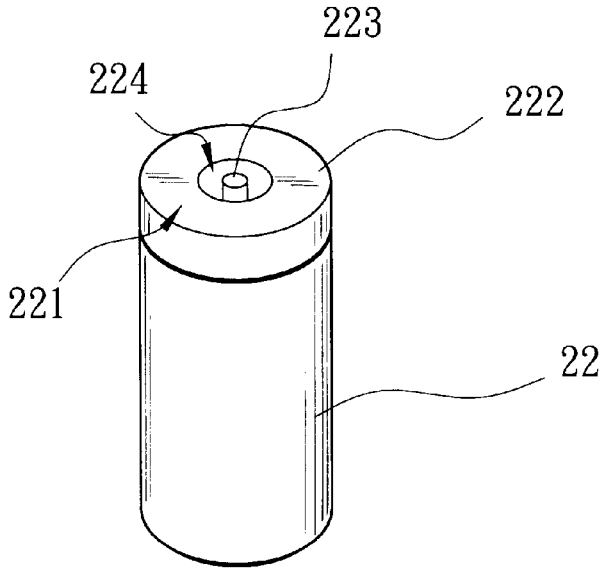

Please see FIGS. 2B and 2C for the detailed structure of the connector. One end of the connector is a connecting plane 221. The connecting plane 221 has a concave annular insulating region 224. The insulating region divides the connecting plane 221 into a first connecting region 223 and a second connecting region 222. The first connecting region 223 is the central area, while the second connecting region 222 surrounds the insulating region 224. That is, the connector 22 is attached to the connecting part 151 on the first surface 112 of the substrate 11 using almost the whole connecting plane 221 except for the insulating region 224. Therefore, the connection area is so large that the connection between the connector 22 and the substrate 11 is fairly firm. The connection is unlikely to be broken or become loose due to improper uses or force exertion.

Figure 4:
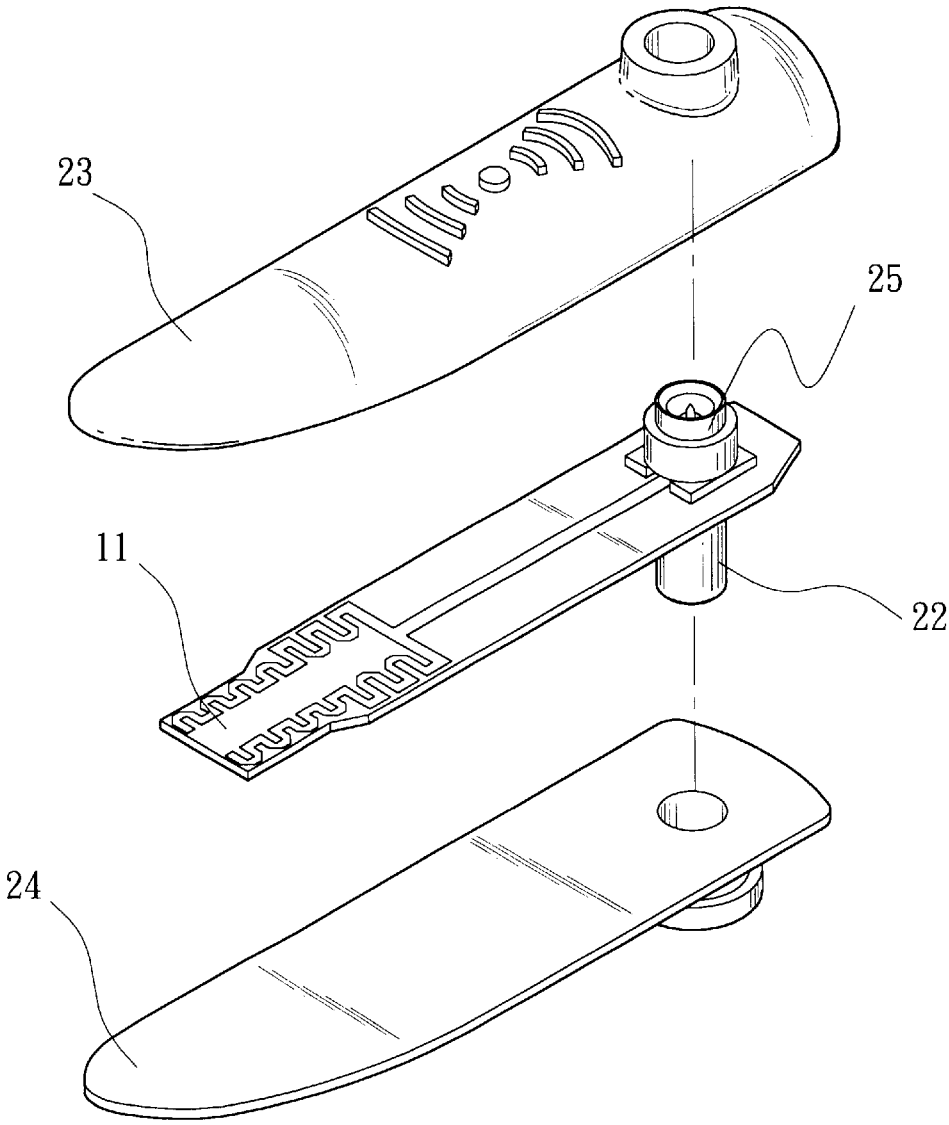
FIG. 4 is a schematic view of the invention in combination with an extension connector.

Moreover, as shown in FIG. 4, the second surface 111 is further provided with an extension connector 25 at the corresponding position of the connecting part 151 on the first surface 112. The extension connector 25 is used to connect with an external antenna to enhance the signal transmission ability of the disclosed antenna.

The invention discloses a printed antenna. The connecting plane of the connector has a concave annular insulating region, dividing the plane into a central area and an area surrounding the insulating region. These two areas are of the same height to enlarge the connecting area with the substrate. This method can effectively enhance the connecting between the connector and the substrate so that it does not break or fall apart due to improper uses of force exertion. The manufacturing cost can also be lowered while at the same time maintaining the quality of signal transmissions.

What is claimed is:

1. A printed circuit antenna for a wireless transmitting device, which comprises:

a substrate having a first surface and a second surface opposite to each other, the two surfaces having a feed line, a feed section, and a radiation section for wireless data transmissions, one end of the first surface connecting to a connector and the other end to the wireless transmitting device; and said connector containing a connecting plane for connecting to the first surface of the substrate, the connecting plane having a concave annular insulating region separating the connecting plane into insulated first connecting region and second connecting region.

2. The printed circuit antenna of claim 1, wherein the second surface of the substrate is installed with an extension connector for connecting to an external antenna.

3. The printed circuit antenna of claim 1 further comprising a shell covering the substrate except for the connector.

4. The printed circuit antenna of claim 3, wherein the shell is comprised of an upper shell and a lower shell that are connected to each other through a connecting means.

5. The printed circuit antenna of claim 1, wherein the first connecting region and the second connecting region of the connecting plane on the connector are on the same plane and the second connecting region surrounds the annular insulating region and the first connecting region.

* * * * *